US007056108B2

(12) United States Patent
Behling et al.

(10) Patent No.: US 7,056,108 B2
(45) Date of Patent: Jun. 6, 2006

(54) COOLED SCREW-TYPE VACUUM PUMP

(75) Inventors: Manfred Behling, Köln (DE); Hartmut Kriehn, Köln (DE); Klaus Rofall, Rösrath (DE); Ralf Steffens, Steinen (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/495,796

(22) PCT Filed: Oct. 30, 2002

(86) PCT No.: PCT/EP02/12086

§ 371 (c)(1),
(2), (4) Date: May 14, 2004

(87) PCT Pub. No.: WO03/042541

PCT Pub. Date: May 22, 2003

(65) Prior Publication Data

US 2004/0265160 A1 Dec. 30, 2004

(30) Foreign Application Priority Data

Nov. 15, 2001 (DE) ..... 101 56 180

(51) Int. Cl.
*F03C 2/00* (2006.01)
*F04C 15/00* (2006.01)

(52) U.S. Cl. ..... 418/85; 418/88; 418/97; 418/201.1

(58) Field of Classification Search ..... 418/85, 418/201.1, 88, 97
See application file for complete search history.

(56) References Cited

U.S. PATENT DOCUMENTS

| | | | | | |
|---|---|---|---|---|---|
| 4,475,876 | A | * | 10/1984 | Olen | 418/85 |
| 4,725,210 | A | * | 2/1988 | Suzuki et al. | 418/85 |
| 4,929,161 | A | * | 5/1990 | Aoki et al. | 418/85 |
| 5,328,344 | A | | 7/1994 | Sato et al. | |
| 6,544,020 | B1 | | 4/2003 | Bahnen et al. | |
| 2003/0147764 | A1 | | 8/2003 | Kreihn | |
| 2004/0022646 | A1 | | 2/2004 | Garczorz | |

FOREIGN PATENT DOCUMENTS

| | | | | | |
|---|---|---|---|---|---|
| BE | 1008367 | | | 4/1996 | |
| DE | 2217022 | | | 10/1973 | |
| DE | 2013785 | A | * | 8/1979 | 418/85 |
| DE | 4320537 | | | 12/1993 | |
| DE | 19745616 | | | 4/1999 | |
| DE | 19820523 | | | 11/1999 | |
| DE | 19849098 | | | 4/2000 | |
| DE | 200133338 | U | | 12/2000 | |
| DE | 19945871 | | | 3/2001 | |
| DE | 19963171 | | | 6/2001 | |
| DE | 19963172 | | | 6/2001 | |
| DE | 10019066 | | | 10/2001 | |
| EP | 0074514 | | | 3/1983 | |
| GB | 1379378 | | | 1/1975 | |
| GB | 1557296 | A | * | 11/1976 | 418/85 |
| JP | 03175166 | | * | 7/1991 | 417/368 |
| JP | 11013674 | A | * | 1/1999 | 418/85 |

* cited by examiner

*Primary Examiner*—Theresa Trieu
(74) *Attorney, Agent, or Firm*—Fay, Sharpe, Fagan, Minnich & McKee, LLP

(57) ABSTRACT

A screw-type vacuum pump (1) includes a pump housing (2, 6) with rotors (3, 4). A liquid cooling system cools the rotors and a drive motor (9). In order to improve the cooling of said pump, an external air-flow impelled cooling system is also provided for the pump housing (2, 6).

11 Claims, 1 Drawing Sheet

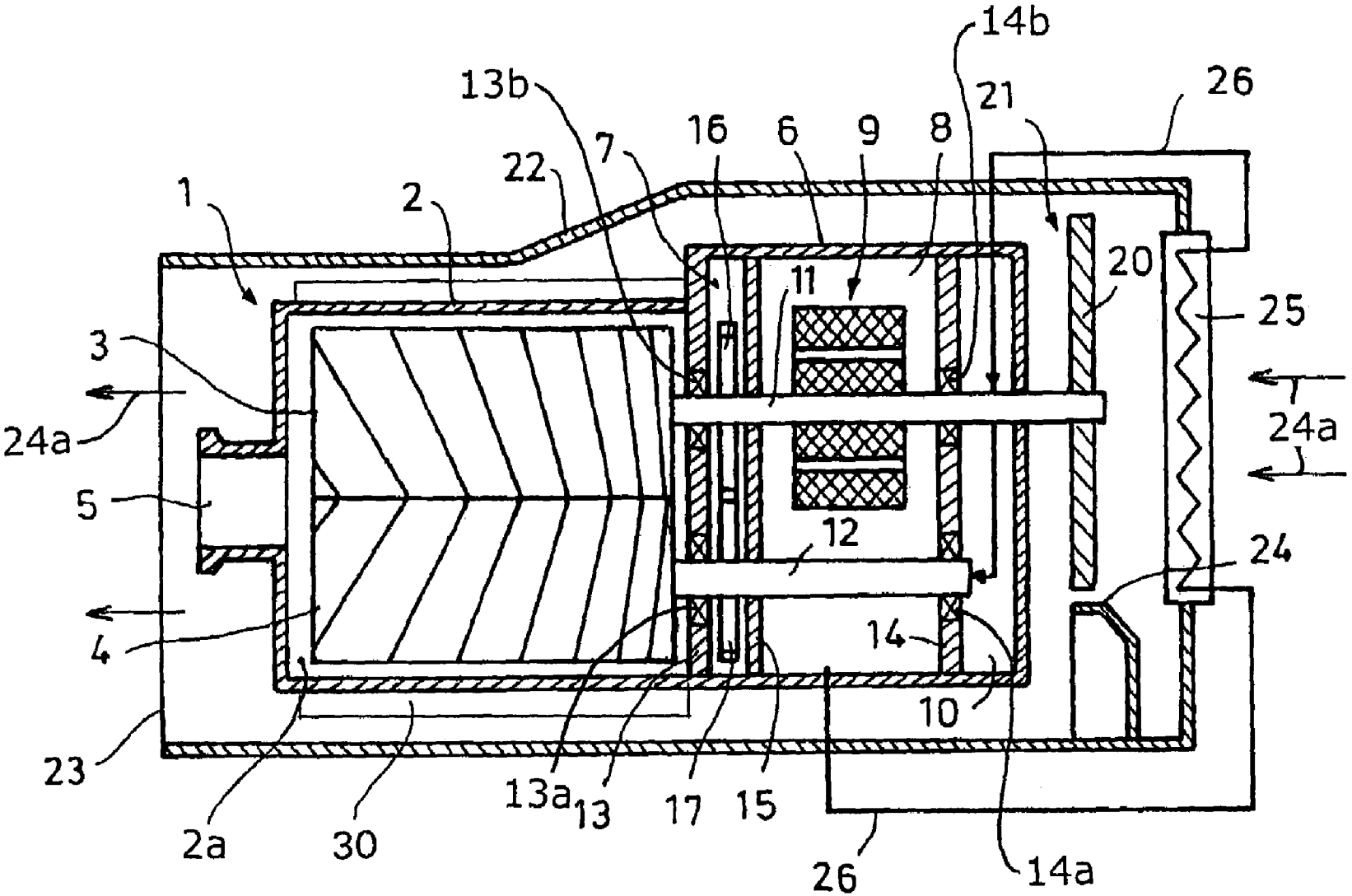
26
25
24a
24
20
14b
21
8
9
6
16
7
13b
22
2
1
3
24a
5
4
23
2a
30
13a
13
17
15
26
14a
10
14
12
11

COOLED SCREW-TYPE VACUUM PUMP

BACKGROUND OF THE INVENTION

The invention relates to a screw-type vacuum pump comprising a pump housing with rotors arranged therein, a liquid cooling system for the rotors and a drive motor.

DE-A-198 20 523 document discloses multiple problems involved in cooling screw-type vacuum pumps when these shall be built for, and operated at high performance densities—compact and operating at high rotational speeds.

It is the task of the present invention to improve the cooling system for a screw-type vacuum pump having the aforementioned characteristics. This task is solved through the present invention through the characterising features of the patent claims.

SUMMARY OF THE INVENTION

The additional cooling system in accordance with the present invention for cooling the pump housing from the outside, specifically by way of an impelled air flow produced by a fan linked to the motor, for example, considerably relieves the liquid cooling system for the rotors accommodated within the pump of stress. In addition, it is possible with the aid of the impelled air flow to also cool a heat exchanger through which the cooling liquid of the rotor cooling system flows.

The present invention allows the implementation of a cooling concept for a screw-type vacuum pump in which the entire machine is air cooled although in addition a liquid cooling system for the rotors is present. The produced heat is in fact dissipated by two different heat carriers (liquid for the inner rotor cooling system, outer cooling air flow). Finally the heat, however, is in total disspated by the cooling air flow. This also applies to the dissipation of secondary heat flows produced by motor losses, gear and bearing losses, etc.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

The FIGURE is a longitudinal transverse view of a vacuum pump in accordance with the present invention.

DETAILED DESCRIPTION OF THE PREFERRED EMBODIMENTS

In the drawing FIGURE, the screw-type vacuum pump which is to be cooled is designated as 1, its pump or rotor chamber housing with 2 which defines a rotor or first chamber 2*a* in which rotors with 3, 4 are disposed and which has an inlet 5, and the gear/motor chamber housing with 6, the latter being adjacent with respect to the pump chamber housing 2 with the rotors 3, 4. An outlet on the delivery side is not depicted. Accommodated in the housing 6 is a second chamber 7, 8, 10 including the gear chamber 7, the motor chamber 8 with the drive motor 9 and a further chamber 10, being a component of the liquid cooling circuit for the rotors 3, 4.

The rotors 3, 4, are equipped with shafts 11, 12 which penetrate the gear chamber 7 and the motor chamber 8. Through bearings 13*a*, 13*b*; 14*a*, 14*b* in the separating walls between pump chamber and gear chamber 7 (separating wall 13) as well as motor chamber 8 and cooling liquid chamber 10 (separating wall 14), the rotors 3, 4 are suspended in a cantilevered manner. The separating wall between gear chamber 7 and motor chamber 8 is designated as 15. Accommodated in the gear chamber 7 is a pair of toothed wheels 16, 17 effecting the synchronous rotation of the rotors 3, 4. The rotor shaft 11 is simultaneously the drive shaft of the motor 9. The motor 9 may even be equipped with a drive shaft differing from the shafts 11, 12. In the instance of such a solution its drive shaft terminates in gear chamber 7 and is equipped there with a toothed wheel which intermeshes with one of the synchronizing toothed wheels 16, 17 (or a further toothed wheel, not depicted, of the shaft 12).

Shaft 11 penetrates the chamber 10, is run out, of the housing 6 of the pump 1 and carriers at its occupied end the wheel 20 of a ventilator or fan 21. A housing 22 encompassing the pump 1 serves the purpose of guiding the air flow produced by blade wheel 20 in an air flow direction 24*a*, said housing being open (apertures 23, 24) in the area of both face sides.

In the sense of the present invention, the fan 21 is operated such that the aperture 24 on the fan/motor side forms the air inlet aperture. Assigned to this aperture is a heat exchanger 25 through which the cooling liquid of the internal rotor cooling system flows. Expediently, the heat exchanger 25 is located upstream of fan 21 so that it simultaneously forms a means of touch protection for the blade wheel 20. The advantage of this arrangement is, that the air flow cooling the pump chamber housing 2 of the pump 1 is pre-warmed. In this manner it is achieved that thermal expansions of the pump chamber housing 2 are allowed to such an extent that the rotors 3, 4 attaining during operation of pump 1 relatively high temperatures, do not come into contact with the housing 2. Preferably, the housing 2 and the rotors 3, 4 are made of aluminium for the purpose of improving heat conductance. Moreover, the housing 2 may exhibit fins 30 for improving the thermal contact. Through the size of the heat exchanger 25 and also through the degree by which the pump chamber housing 2 is equipped with fins, the gap between the rotors 3, 4 and the housing 2 is adjusted.

The cooling liquid circuit for cooling to rotors 3, 4 is depicted only schematically. In U.S. Pat. No. 6,544,020, DE 199 63 171 and U.S. 2003/147764, cooling systems of this kind are described in detail. The shafts 11 and 12 serve the purpose of conveying the coolant (oil, for example) to and from the rotors 3, 4. In the example of the depicted embodiment, the coolant exiting the rotors 3, 4, collects in the motor chamber 8. From there the coolant is supplied through the line 26 to the heat exchanger 25. The air flow produced by fan 21 dissipates the heat which was dissipated by the cooling liquid in the rotors, 3, 4. The liquid exiting the heat exchanger 25 is supplied through the line 26 to the chamber 10. In a manner not depicted in detail it passes from there through bores in the shafts 11, 12 to the rotors 3, 4, flows there through cooling ducts and passes through the shafts 11, 12 back into the motor chamber 8.

It has been found to be expedient to adjust the cooling system such that approximately half of the heat generated by the pump is first dissipated by the cooling liquid and thereafter removed through the heat exchanger 25, and such that the other half is dissipated directly by the cooling air flow.

In all, the characteristics in accordance with the present invention allow a further increase in the performance density of a screw-type pump. The pump may be designed to be smaller and may be operated at higher surface temperatures.

The housing 22 serving the purpose of guiding the outer air flow has, in addition, the function of providing a means of touch protection.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A screw-type vacuum pump comprising:

an inner pump housing;

a pair of rotors rotatably mounted in the inner pump housing;

a drive motor mounted in the inner pump housing;

an outer housing displaced from the inner pump housing to define a passage for cooling air therebetween, such that cooling air flowing between the inner and outer housings removes heat from the rotors and drive motor;

a liquid cooling system for circulating a cooling liquid for cooling the drive motor and the rotors;

a heat exchanger mounted to pre-heat the cooling air upstream of the inner housing, the heat exchanger being connected with the liquid cooling system to move heat from the cooling liquid to the cooling air.

2. The pump according to claim 1 further including a fan mounted in the outer housing for propelling air through the heat exchanger and the air cooling passage between the inner and outer housings.

3. The pump according to claim 1 wherein the heat exchanger and the cooling air passage are sized such that as the rotors heat and undergo thermal expansion, the inner pump housing thermally expands to such an extend that the rotors do not come into contact with the inner pump housing.

4. A screw-type vacuum pump comprising:

an inner pump chamber housing and an inner motor chamber housing having a least first and second chambers separated by at least one separating wall;

a pair of rotors rotatably mounted in the first chamber of the inner pump housing;

a drive motor mounted in the second chamber of the inner motor chamber housing;

each of the rotors being equipped with a shaft suspended in bearings, located in the at least one separating wall;

a first cooling system including a liquid cooling system for circulating a cooling liquid for internally cooling the rotors, the liquid cooling system including a heat exchanger, the shafts of the rotors serving to convey the liquid coolant, cooled by the heat exchanger, to the inner of the rotors, liquid coolant heated by the rotors being conveyed to the heat exchanger;

a second cooling system including:

an outer housing displaced form the inner pump and motor chamber housings to define a passage for cooling air therebetween and defining an inlet aperture and an outlet aperture such that cooling air flowing in the passage between the inner and outer housings removes heat from the said inner housing, a fan mounted in the outer housing for propelling air through the air cooling passage between the inner and outer housings;

the heat exchanger being located adjacent the inlet aperture of the outer housing, such that the fan moves air both through the heat exchanger and through the air cooling passage, so that the cooling air, flowing between the inner pump and motor chamber housings and the outer housing, is pre-warmed by the heat exchanger.

5. The screw-type vacuum pump according to claim 4, wherein in the heat exchanger, the fan, the motor chamber housing which defines the second chamber to house the drive motor and the pump chamber housing which defines the first chamber that houses the rotors are arranged sequentially in a direction of the flow of air.

6. The screw type vacuum pump according to claim 4, wherein the fan is linked to the drive motor.

7. The screw type vacuum pump according to claim 6, wherein the fan, the drive motor and the rotor housing are arranged sequentially in a direction of the flow.

8. The screw type vacuum pump according to claim 4, wherein at least the rotor housing is equipped with outer fins.

9. The screw type vacuum pump according to claim 4, wherein the rotor housing and the rotors are constructed of aluminum.

10. The screw type vacuum pump according to claim 4, wherein the fan is located adjacent the inlet aperture.

11. The screw type vacuum pump according to claim 4, wherein the liquid cooling system is designed such that quantities of heat dissipated directly by the first cooling system and the second cooling system, are approximately equal.

* * * * *